United States Patent [19]

Long

[11] 3,936,085

[45] Feb. 3, 1976

[54] DOOR LOCK PROTECTOR

[76] Inventor: Donald L. Long, 6621 W. 94th Terrace, Overland Park, Kans. 66212

[22] Filed: Feb. 24, 1975

[21] Appl. No.: 552,695

[52] U.S. Cl. ..... 292/264

[51] Int. Cl.[2] ..... E05C 17/36

[58] Field of Search ..... 292/264, 346; 70/93

[56] References Cited

UNITED STATES PATENTS

| | | | |
|---|---|---|---|
| 1,924,627 | 8/1933 | Segal | 292/264 X |
| 2,683,054 | 7/1954 | Earman | 292/346 X |
| 3,764,173 | 10/1973 | Griffith | 292/346 |
| 3,809,418 | 5/1974 | Canfield | 292/264 |

*Primary Examiner*—Richard E. Moore

*Attorney, Agent, or Firm*—John A. Hamilton

[57] ABSTRACT

A lock protector for wooden doors equipped with both the usual bolt or latch lock and the common safety chain, consisting of a strong metal door plate of U-form adapted to bridge the free edge portion of a door at the lock and apertured to pass the lock bolt, and a chain plate adapted to be strongly affixed to the door frame, the safety chain being permanently affixed to the door plate and detachably connected to the chain plate. Strong affixation of the plates to the door and door frame resists tearing out the chain connections by kicks, blows, or pressure applied to the door, and the form of the door plate offers similar protection to the bolt assembly. Additionally, the chain plate is specially formed to prevent the common type of break-in known as "credit card" entry.

3 Claims, 7 Drawing Figures

DOOR LOCK PROTECTOR

Figures 1, 2, 3:
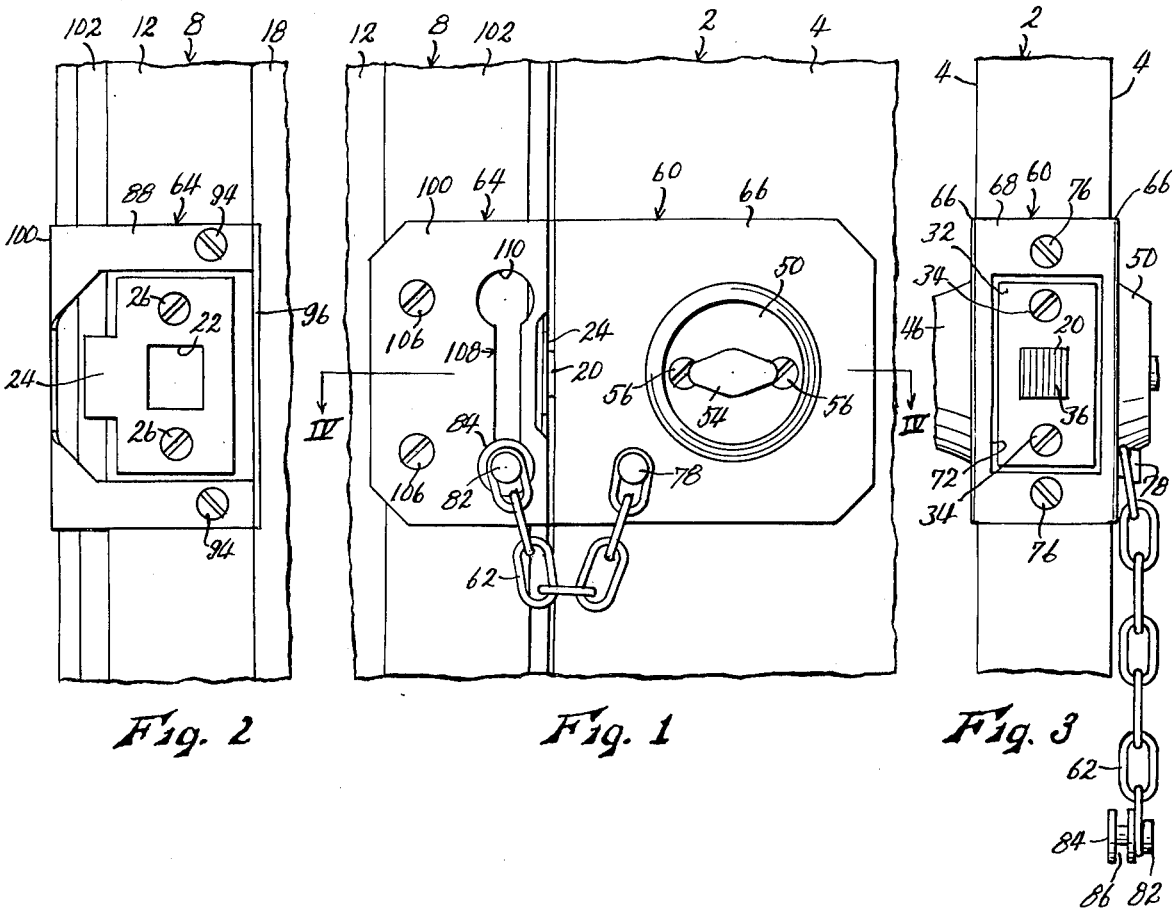

This invention relates to new and useful improvements in door hardware, and has as its principal object the provision of protecting means greatly strengthening a locked door against being broken open forcibly by kicks or shoulder blows applied thereto by would-be burglars or other intruders.

Many wooden doors are easily broken open by blows as described above, due in part to the fact that the bolt portion of the lock assembly, which projects outwardly through a bore in the free edge of the door for engagement in a striker plate fixed to the door frame, usually has a thickness, normally to the door plane, constituting a major portion of the door thickness, so that the bolt assembly is supported normally to the door plane only by quite thin sections of wood which may be broken away easily by blows on the outer surface of the door. Also, the present door constructions most commonly used are structurally quite weak, doors often being of hollow-core construction consisting of veneer panels separated only by edge strips of solid wood, and even so-called solid-core doors often consist only of thin veneer face panels with a core of pressed wood, which is formed of wood chips more or less solidly bonded together. Such pressed wood, while satisfactorily strong in large pieces when a load is applied over a large area thereof, is nevertheless very weak against localized stresses, and cannot supply a firm anchor even for a wood screw. With either of the door constructions described, the type of breakage described is still more easily accomplished. Also, pressed wood boards as described are often used in door frames.

If a door is equipped with a common safety chain, which permits the door to be opened to a slight degree while it is still secured against full opening by the chain, very similar problems are encountered, due to the virtual impossibility of providing suitably secure mounting of the end fittings of the chain on the door and door frame respectively. The small screws commonly used for securing these fittings to the door and door frame are completely inadequate to prevent opening of the door by ripping one end or the other of the chain free with a kick on the door. Also, if the lock bolt is of the spring loaded type rather than a dead-bolt, it usually can be retracted by a credit card or other thin member properly inserted between the door and door frame. As a result of all of these factors, many doors may be so easily forced open as to render the use of high quality lock hardware rather pointless, leading only to a sense of false security.

The present invention contemplates the provision of a lock protector assembly which largely solves all of the above enumerated problems in a satisfactory manner. The assembly includes a strong, U-shaped metal plate adapted to bridge the thickness of the door, around its free edge, and extending well above and below the lock bolt, the connecting portion of said door plate being apertured to pass the bolt and the plate being rigidly affixable to the door. The door plate in effect renders the entire thickness of the door, in the region of the lock, a solid, strong unitary structure, so that break-in by blows would require the forcible removal of a large section of the entire thickness of the door, rather than merely breakage of a thin wood section, often no more than one-quarter inch thick, at one face of the door. This door plate also serves as an anchor for one end of the safety chain. The assembly also includes a strong metal chain plate, to which the opposite end of the safety chain is detachably secured, and which is formed to be securely affixed to the door frame by a plurality of long screws extending at right angles to each other into the base structure of the door frame, not merely its surface members, so as to remain secure against any force ordinarily deliverable by physical means. The chain plate is also specially formed to bar the "credit card" type of entry. The assembly of course will not defeat a determined professional burglar, nothing will, but it will prevent entry by the more or less "amateur" or casual burglars who are apparently multiplying at an alarming rate. Hotel and apartment house operators report a radical rise in this type break-in. The present device will effectively prevent this type of entry by any single person not equipped with special tools.

Other objects are simplicity and economy of construction, efficiency and dependability of operation, and the provision of a lock protector which may be used either in conjunction with the existing lock hardware already installed in a door, or, with minor changes, supplied as original equipment by the lock manufacturer.

Figure 4:
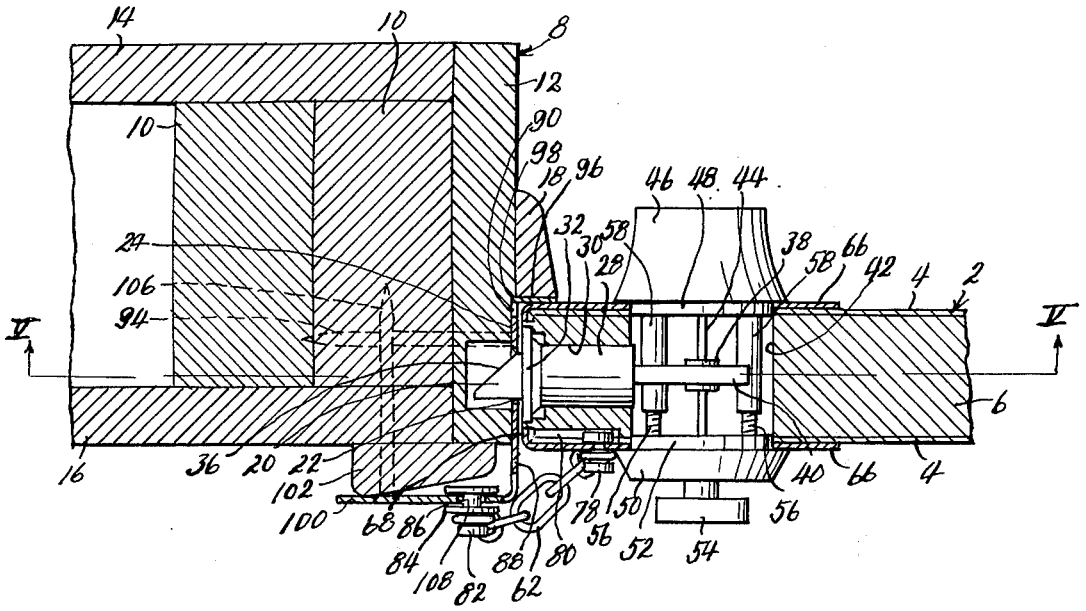
Figure 5:
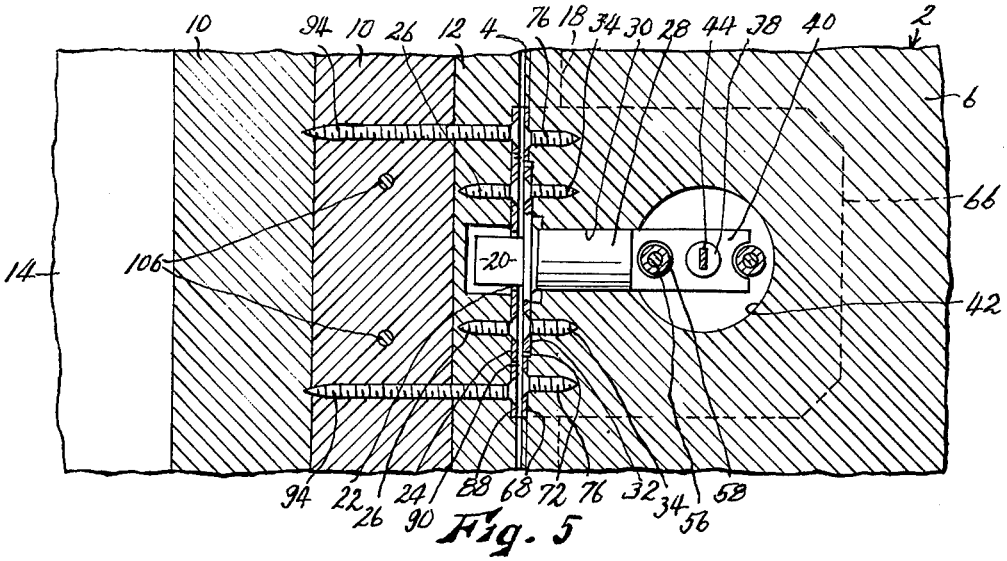
Figure 6:
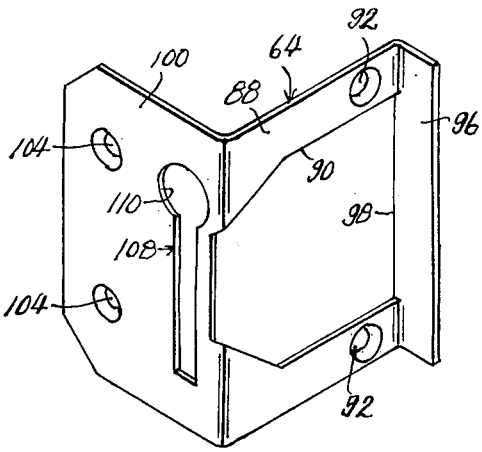
Figure 7:
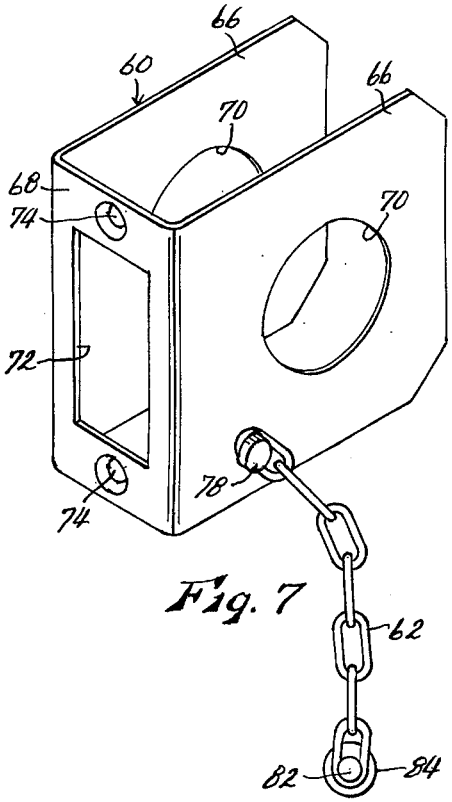

With these objects in view, as well as other objects which will appear in the course of the specification, reference will be had to the accompanying drawing, wherein:

FIG. 1 is a fragmentary inside elevational view of a door and door frame, showing the lock and adjacent portions of the door and frame, and including a lock protector embodying the present invention, FIG. 2 is a fragmentary elevational view of the face of the door frame confronting the free edge of the door, FIG. 3 is a fragmentary elevational view of the free edge of the door, FIG. 4 is a slightly irregular fragmentary sectional view taken on line IV—IV of FIG. 1, FIG. 5 is a slightly irregular sectional view taken on line V—V of FIG. 4, FIG. 6 is a perspective view of the chain plate portion of the lock protector, and FIG. 7 is a perspective view of the door plate portion of the lock protector.

Like reference numerals apply to similar parts throughout the several views, and the numeral 2 applies generally to a wooden door of a type commonly used for dwellings, apartments and the like. The door is of course essentially a planar slab, and the particular door shown is of the so-called solid core type, consisting of spaced apart parallel sheets 4 of finish veneer with the space between said panels occupied by a filler core 6 which is often merely pressed wood, or wood chips bonded together, and to panels 4, by a suitable adhesive. As previously noted, such doors are structurally very weak, and provide no secure anchorage for wood screws. Another door in common usage is the hollow-core door, in which the space between panels 4 is hollow except for spacer boards at the edges of the door. This type of door is structurally even weaker than the solid-core door shown. The free vertical edge of the door cooperates with a door frame 8 in the usual manner, the door frame including a door post formed by two vertical 2 × 4 boards 10, a frame facing board 12 affixed to the side of the post confronting the free edge of the door, and wall boards 14 and 16 (or frame trim boards) affixed respectively to the outer and inner faces of the post. The door closes against a stop strip 18 nailed to frame facing board 12, as clearly shown in FIG. 4.

The door lock mechanism, many of the details of which are not pertinent to the present invention, includes a bolt 20 which projects horizontally outwardly through the free edge of the door for engagement in a hole 22 formed therefor in a striker plate 24 securely affixed to facing board 12 of the door frame by screws 26. Said striker plate is mortised into said facing board to lie flush with the exposed surface thereof. The bolt is slidable in a barrel 28 inserted inwardly into a bore 30 formed therefor in door core 6, and the barrel is provided with a face plate 32 affixed thereto, said face plate normally being mortised into the door to lie flush with the free edge surface of the door, and secured thereby screws 34. However, this mounting of the bolt is not normally secure, due to the fact that door core 6 is locally quite fragile, and provides only poor anchorage for screws 34. The bolt is spring loaded outwardly in barrel 28, and its outer end is bevelled as indicated at 36 so that it will be cammed inwardly by striker plate 24 to permit closure of the door, but will then spring outwardly into hole 22 of the striker plate to prevent opening of the door until retracted by other means.

The bolt may be retracted from the striker plate against its spring by the turning of a bushing 38 carried rotatably, on an axis normal to the door plane, in an inward extension 40 of bolt barrel 28, said bushing being disposed within a bore 42 formed through the door normally to its plane. The mechanism within the barrel and its extension by which retraction of the bolt is accomplished by turning bushing 38 is common and well known in the art, and is not shown. The bushing is turned by rotation of a flat, elongated blade 44 also extending normally to the door plane, and extending non-rotatably through said bushing. At the outer face of the door, the blade engages a key mechanism 46 mounted externally of the door, and having a reduced base 48 engaged in bore 42 of the door, so that the blade may be turned to retract the bolt only by insertion of the proper key in a keyhole (not shown) of the key mechanism. At the inner face of the door, the blade engages a knob mechanism 50 also mounted externally of the door and having a reduced base portion 52 engaged in door bore 42, and including a manually operable knob 54 by means of which the blade may be turned without the necessity of a key. Obviously both the key mechanism and the knob mechanism may include standard doorknobs of ordinary design, but of course the knob of the lock mechanism could not be turned except when the proper key was inserted. The key and knob mechanisms both overlap the outer surfaces of the door adjacent bore 42, and are secured in place by a pair of screws 56 inserted outwardly of the door through the base portion of the knob mechanism and engaged in internally threaded bosses 58 carried by the base portion of the key mechanism.

The structure thus far described is common in the art, but permits unauthorized entry by a sharp kick or shoulder blow to the outer surface of the door. As a result of such a blow, the bolt itself being restrained by striker plate 24, the bolt barrel 28 tends to break through the outer surface of the door as the door moves inwardly, by fracturing and tearing out of the door core 6 and veneer panel 4 directly adjacent the barrel, and the door is forced open. This can be done especially easily if the door core is pressed wood or other similarly fragile material, but is not difficult even if the door is a solid plank, since the diameter of the barrel is often nearly as great as the door thickness, leaving only thin sections of wood between said barrel and the door faces. If the door bolt is released but the door is equipped with a safety chain lock, it may still be forced easily by a sharp kick or blow, due to the difficulty of obtaining secure anchorage for the chain ends on the door and door frame. Such safety chains are ordinarily equipped with end fittings adapted to be affixed to the door and door frame by small wood screws. These provide little security if the door or door frame are formed of material which does not provide good anchorage for screws, and the door can still be kicked open.

The present lock protector has been designed to prevent or at least seriously inhibit these occurrences, as well as the common "credit card" type of break-in, in which stop strip 18 is pried away from the facing board 12 of the door frame, and a credit card or other slender object passed therebetween to engage the bevelled end 36 of the bolt to cam it free of striker plate 24. The present lock protector basically includes a door plate 60, a safety chain 62, and a chain plate 64, all as clearly shown in FIGS. 6 and 7.

Door plate 60 is formed of strong sheet metal, such as 16 gauge sheet steel, and is bent into a U-form as indicated in FIG. 7, in order to be adapted to be fitted snugly about the free edge portion of the door as best shown in FIG. 4, in the region of the lock mechanism. It includes a pair of spaced apart, parallel planar legs 66 which lie snugly against the inner and outer faces of the door, and a connecting portion 68 which bridges the free edge of the door. Legs 66 each have an aperture 70, which register with bore 42 of the door and receive the base portions 48 and 52 of the key and knob mechanisms respectively therein. The screws 56 securing the key and knob mechanisms thus also secure the door plate 60 rigidly to the door. Connecting portion 68 is preferably mortised into the free edge of the door to lie flush therewith, which may be accomplished by merely enlarging the mortise originally formed for face plate 32 of bolt barrel 28. Said connecting portion is provided with an aperture 72 for accomodating face plate 32, and may also be provided with apertures 74 for receiving screws 76 for further securing the door plate to the door, but these screws provide little holding power if the door core is of pressed wood or the like, and may be omitted if desired. In the leg 66 at the inner face of the door is affixed a headed rivet 78 on which is permanently engaged one end link of safety chain 62. The rivet head at the inner surface of the associated leg 66 is accomodated by a cut-out 80 formed in the mating surface of the door (see FIG. 4). The opposite end link of the safety chain has permanently mounted therein a stud 82 having a cylindrical head 84 with a peripheral groove 86 formed therein. Said stud is adapted to be engaged releasably in chain plate 64, as will appear.

Chain plate 64 is of dog-leg form as best shown in FIG. 6. It includes a central portion 88 adapted to lie flat against the exposed surface of facing board 12 of the door frame, substantially in registry with connecting portion 68 of the door plate. Its central portion is cut out, as indicated at 90, to accomodate striker plate 24, and it is preferably mortised into the facing board to lie flush therewith, and with the striker plate. Central portion 88 also has apertures 92 formed therein for receiving a plurality of long wood screws 94 adapted to extend well into the door post formed by 2 × 4 boards 10. Central portion 88 of the chain plate extends outwardly of the door to stop strip 18, and is provided at this vertical edge with a leg 96 overlying the inner edge of said stop strip. This leg is preferably mortised into the stop strip, but is not affixed thereto in any way. It is also provided with a lip 98, (see FIGS. 4 and 6), which extends to the full depth of the mortise formed in facing board 12 for the striker plate and for central portion 88 of the chain plate. Central portion 88 of the chain plate extends inwardly of the door frame beyond the inner vertical edge of frame facing board 12, and beyond the inner wall board 16, and is provided at this vertical edge thereof with a right-angled leg 100 which is spaced horizontally apart from said facing and wall boards. Leg 100 engages a trim strip 102 nailed to the associated wall board, and is provided with apertures 104 for receiving a plurality of long wood screws 106 which extend through leg 100, trim strip 102, wall board 16, and well into the 2 × 4 boards of the door post. These screws are of course at right angles to screws 94. Also formed in leg 100 of the chain plate, adjacent the angle between said leg and central portion 88, is a vertical keyhole slot 108. The upper end of said slot is circularly enlarged as indicated at 110 to a diameter sufficient to receive head 84 of stud 82 therein, but its lower portion is sufficiently narrow to engage in groove 86 of said stud head when said stud is lowered, whereby to secure said stud in engagement. Trim strip 102 is bevelled as shown or cut-out behind leg 100 of the chain plate, to permit insertion of the stud.

Operation of the lock protector is believed to be self-evident. If a kick or heavy blow is delivered to the outer surface of the door, it will tend to move the bolt barrel 28 outwardly relative to the door, but this movement will be resisted by outer leg 66 of the door plate, and the force on this leg will be transmitted by connecting portion 68 of the door plate to inner leg 66, which distributes the load over a large area of the inner surface of the door. Thus, for the door to yield, it is necessary not merely that a thin section of wood at the side of barrel 28 be broken out, but that a section of the entire thickness of the door, at least as great in area as the legs 66 of the door plate, be broken out. The area of these plate legs may be as great as desired, and this renders what was previously the weakest portion of the door its strongest portion, and places this type of breakin well beyond the physical strength of an ordinary man working without special tools. It will be apparent that much of the door strengthening effect provided by the door plate results from connecting portion 68 of said plate, which transfers load from one leg to the other of the plate, and could not be provided by the already well known practice of overlying the respective faces of the door, in the region of the lock, with separate metal plates affixed to the door, but not to each other as in the present concept.

Of course, when a blow of the type described is delivered to the door, striker plate 24 and its screws 26 are also subjected to heavy stress. These members may be strengthened or made heavier if desired, but it has been demonstrated in practice that it is nearly always the door which yields, not the door frame.

If lock bolt 20 is unlatched and the door opened slightly, but safety chain 62 is engaged, doors are still often forced by kicking or the like as already described. The chain itself may readily be sufficiently strong to prevent this type of entry, but the end fittings of the chain are rather easily torn loose from the door or door frame when they are mounted in the usual manner, consisting usually of small screws engaged in wood. The present device also offers protection in this respect. The door end of the chain is solidly connected to door plate 60, which as previously described cannot yield without breaking out a large area of the entire thickness of the door, so this end of the chain cannot be disconnected from the door by any physical means within the strength of an ordinary man. The opposite end of the chain is engaged directly in chain plate 64, which in turn is secured by screws 94 and 106 to the door post itself, not merely to surface or trim boards. Since screws 94 and 106 are at right angles to each other, separation of the chain plate from the door frame by force would require strong pulling force in two directions at the same time, longitudinally of both sets of screws. This would require an extreme force, causing virtual demolition of the door frame, and is well beyond the physical strength of any ordinary man.

Perhaps the commonest type of illegal entry, at least where a door is equipped with a spring bolt and not a dead bolt, is the "credit card" entry, in which stop strip 18 is pried away from facing board 12 of the door frame, this being easy since the stop board is usually secured only by small nails, and a credit card or other thin, stiff member inserted therebetween and extended to engage the bevelled end 36 of bolt 20 and cam it out of engagement in the striker plate against its spring. The present device also offers protection against this type of entry. If the stop strip is pried out and the card inserted, it encounters only the leg 96 of the chain plate, and is blocked thereby against access to the bolt. Lip 98 of this leg, which extends to the bottom of the striker plate mortise, prevents any tool from being inserted to pry leg 96 outwardly from the door frame. Said leg, not being connected to the stop strip in any way, is not pried outwardly with the stop strip.

Finally, it will be noted that while the door and chain plates are shown as apertured to accomodate the barrel face plate of the door lock and the striker plate of the door frame, it would also be possible to form the face plate and striker plate as integral portions of the door plate and chain plate respectively. In that case, the bolt barrel 28 would be affixed directly to connecting portion 68 of the door plate, which would then be apertured only to pass bolt 20 itself, and the striker plate aperture 22 would be formed directly in central portion 88 of the chain plate. This modification would offer a somewhat still greater strength, in that the holding force would then be completely independent of any connection of the striker plate and the barrel face plate to the door frame and door respectively, and would also better adapt the device for use as original equipment to be supplied by the manufacturer of the lock mechanism itself. As shown, the device is intended primarily for use on doors having previously installed lock mechanisms.

While I have shown and described a specific embodiment of my invention, it will be readily apparent that many minor changes of structure and operation could be made without departing from the spirit of the invention.

What I claim as new and desire to protect by Letters Patent is:

1. In combination with a wooden door having opposite vertical faces and opposite vertical edge surfaces, a door frame to which one vertical edge of said door is hinged, and a lock mechanism including a bolt carried in said door and extendable from the free edge of said door, and a striker plate carried by said door frame and engageable by said bolt, a lock protector comprising:

a. a chain plate of right-angled form, a first leg of which overlies the face of said door frame confronting the free edge surface of said door, and the second leg of which overlies the face of said door frame toward which said door opens, b. means affixing both legs of said chain plate rigidly to said door frame, c. a safety chain, and d. means attaching the respective ends of said safety chain to said door adjacent the free vertical edge thereof, and to said chain plate, one of said attaching means being readily detachable, said means attaching one end of said chain to said door comprising a strong, U-shaped metal door plate adapted to enclose the free edge portion of said door with its parallel legs overlying the faces of said door and the connecting portion thereof bridging the free edge surface of said door, one end of said chain being attached to said door plate, and means rigidly affixing said door plate to said door.

2. A lock protector as recited in claim 1 wherein said means affixing said door plate to said door comprises:

a. abutment members overlying the respective parallel legs of said door plate at the outer surfaces thereof, and b. tensile members extending through said door normally to the plane thereof and rigidly interconnecting said abutment members.

3. A lock protector as recited in claim 1 wherein said door plate extends well above and below the bolt of the lock mechanism, and wherein its connecting portion is apertured to pass said bolt.

* * * * *